US007794035B2

(12) United States Patent
Imahashi et al.

(10) Patent No.: US 7,794,035 B2
(45) Date of Patent: Sep. 14, 2010

(54) INKJET PRINTING APPARATUS AND PRINTHEAD DRIVING METHOD

(75) Inventors: Yusuke Imahashi, Kawasaki (JP); Takashi Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 12/174,352

(22) Filed: Jul. 16, 2008

(65) Prior Publication Data

US 2009/0021546 A1 Jan. 22, 2009

(30) Foreign Application Priority Data

Jul. 20, 2007 (JP) ..... 2007-189994

(51) Int. Cl.
*B41J 29/38* (2006.01)

(52) U.S. Cl. ..... 347/12; 347/9; 347/11

(58) Field of Classification Search ..... 347/9, 347/11, 12

See application file for complete search history.

(56) References Cited

U.S. PATENT DOCUMENTS 6,655,772 B2 12/2003 Danzuka et al.
2007/0052738 A1* 3/2007 Edamura et al. ..... 347/5
2007/0139454 A1* 6/2007 Hamasaki et al. ..... 347/12

FOREIGN PATENT DOCUMENTS

JP 4-239649 8/1992
JP 2002-355959 12/2002

* cited by examiner

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

An object of this invention is to decrease the amount of ink mist while keeping the image quality high in inkjet printing. To achieve this object, printing is performed by time-divisionally driving, for each block, a plurality of nozzles for discharging ink. In preliminary discharge, the nozzles are so driven as to set the driving time interval between neighboring nozzles to the first time interval. In printing, the nozzles are so driven as to set the driving time interval between neighboring nozzles to the second time interval longer than the first time interval.

6 Claims, 9 Drawing Sheets

INKJET PRINTING APPARATUS AND PRINTHEAD DRIVING METHOD

BACKGROUND OF THE INVENTION

1. Field of the Invention

The present invention relates to an inkjet printing apparatus capable of discharging liquid by applying energy to the liquid, and a method of driving a printhead used in the inkjet printing apparatus.

2. Description of the Related Art

Inkjet printing apparatuses are mainly used to print photographs and postcards, and have advantages of high-speed printing, high quality, low noise, and printing on a variety of media. Along with recent popularization of digital cameras and personal computers, the market of inkjet printing apparatuses is growing rapidly. The range of use of the inkjet technique is becoming wider such that the inkjet technique of discharging a predetermined amount of droplet and attaching it to a print medium is exploited in the industrial field. Along with this, the printhead used in the inkjet printing apparatus is improving its performance more and more, and the technical innovation is accelerating.

There are mainly known two types of inkjet methods, that is, a Bubblejet® method and piezoelectric method. The Bubblejet® method is a method of applying heat energy to ink to change the ink state accompanied by an abrupt change of volume (generation of bubbles), and discharging ink from an orifice by a force generated based on the state change. The piezoelectric method is a method of applying a voltage to electrodes on the two surfaces of a piezoelectric element to deform the piezoelectric element, and discharging ink from an orifice by the volume change.

By using any of these methods, inkjet printing apparatuses form an image by attaching ink discharged from an orifice onto a print medium.

Since inkjet printing uses ink whose main component is water, the viscosity of ink increases upon evaporation of water or the like, and a discharge failure and clogging readily occur. To avoid the discharge failure and clogging, the orifice is refreshed by executing discharge (preliminary discharge) irrelevant to ink discharge for printing an image before starting the printing operation.

Recently, to meet market needs for higher-resolution images and higher-speed printing for inkjet printing apparatuses and expectation of application of inkjet printing apparatuses to industrial uses, a technique for stably discharging a smaller droplet than the conventional one has been developed. Also, a technique for achieving an objective of suppressing a satellite droplet, which is generated after a main droplet and is smaller than the main droplet has been developed.

Satellite droplets cause various problems. For example, an ink droplet of a smaller particle diameter is more susceptible to the influence of air resistance. Thus, under the influence of an air flow generated when a main droplet passes through air, a subsequent satellite droplet might attach to an unintended portion on a print medium, degrading the image quality. Further, satellite droplets of extraordinarily small particle diameter do not attach to a print medium, but float as ink mist and contaminates the interior of the apparatus.

In preliminary discharge, a print medium is often not fed to an ink discharge position, and ink droplets are readily influenced by air resistance. It is known that the amount of floating mist tends to become larger in preliminary discharge than in printing. As a measure against floating mist, it is effective to decrease mist generated in preliminary discharge.

Japanese Patent Laid-Open No. 4-239649 discloses a technique of controlling driving of a printhead in preliminary discharge. More specifically, Japanese Patent Laid-Open No. 4-239649 discloses a technique of driving a printhead at a driving frequency which changes over time or a driving frequency equal to or higher than that in printing, setting a process of making the ink meniscus of an orifice convex, and removing ink attached to the periphery of the orifice. However, this technique aims to removing ink attached to the periphery of an orifice, and does not decrease ink mist in preliminary discharge.

The present inventors have found that it is possible to change the ink meniscus of an orifice from the convex state to the concave state by changing the driving time interval between adjacent nozzles to generate crosstalk between them. The inventors have also found that as crosstalk between adjacent orifices changes the ink meniscus of the orifice to the convex or concave state, the satellite droplet formation state also changes. The inventors have made extensive studies to find that generation of satellite droplets is greatly reduced by driving nozzles and starting the discharge operation when the ink meniscus of the orifice becomes convex. The inventors have also found that the generation of satellite droplets increases by driving nozzles and starting the discharge operation when the meniscus of the orifice becomes concave.

To reduce ink mist from the above extensive studies, it is effective to drive nozzles and start the discharge operation when the ink meniscus of the orifice becomes convex.

As described above, floating ink mist can be reduced by adjusting the driving time interval between adjacent nozzles, and when the ink meniscus of the orifice becomes convex, driving nozzles and starting the discharge operation. However, the state in which crosstalk occurs is an unstable state, and crosstalk is likely to influence printing. To prevent degradation of the image quality, it is generally known that the nozzle must be driven to start the discharge operation while the influence of crosstalk is minimized. In short, to prevent degradation of the image quality, the driving time interval between adjacent nozzles is preferably as large as possible. To the contrary, to make the ink meniscus of the orifice convex in order to reduce floating ink mist, the driving time interval between adjacent nozzles needs to be set to a predetermined value or smaller. It is revealed that the driving time interval between adjacent nozzles for preventing degradation of the image quality and that for reducing floating ink mist have a trade-off relationship.

That is, if the driving time interval between adjacent nozzles is set large in order to prevent degradation of the image quality, this causes a problem that floating ink mist increases in preliminary discharge and contaminates the interior of the apparatus. On the contrary, if the driving time interval between adjacent nozzles is adjusted to an interval at which crosstalk easily occurs in order to reduce floating ink mist, this causes a problem that degradation of the image quality cannot be prevented.

SUMMARY OF THE INVENTION

Accordingly, the present invention is conceived as a response to the above-described disadvantages of the conventional art.

For example, an inkjet printing apparatus and a method of driving a printhead used in the inkjet printing apparatus according to this invention are capable of both preventing degradation of the image quality and reducing ink mist.

According to one aspect of the present invention, preferably, there is provided an inkjet printing apparatus which prints by time-divisionally driving, for each block, a plurality of nozzles for discharging ink, the apparatus comprising: first driving means for driving the plurality of nozzles so as to set a driving time interval between neighboring nozzles in preliminary discharge to a first time interval; and second driving means for driving the plurality of nozzles so as to set the driving time interval between neighboring nozzles in printing to a second time interval longer than the first time interval.

According to another aspect of the present invention, preferably, there is provided an inkjet printing apparatus which prints an image by time-divisionally driving a plurality of nozzles for discharging ink, the apparatus comprising: first driving means for driving the plurality of nozzles so as to set a driving interval between adjacent nozzles in preliminary discharge to a first interval; and second driving means for driving the plurality of nozzles so as to set the driving interval between adjacent nozzles in image printing to a second interval longer than the first interval, wherein the number of satellite droplets discharged when the first driving means drives the plurality of nozzles is smaller than the number of satellite droplets discharged when the second driving means drives the plurality of nozzles.

According to still another aspect of the present invention, preferably, there is provided a method of driving a printhead which prints by time-divisionally driving, for each block, a plurality of nozzles for discharging ink, the method comprising steps of: driving the plurality of nozzles so as to set a driving time interval between neighboring nozzles in preliminary discharge to a first time interval; and driving the plurality of nozzles so as to set the driving time interval between neighboring nozzles in printing to a second time interval longer than the first time interval.

In accordance with the present invention as described above, the driving time interval between neighboring nozzles is changed between printing and preliminary discharge by selecting a discharge method excellent in printing performance in printing, and a discharge method which reduces the amount of ink mist in preliminary discharge.

The invention is particularly advantageous since the amount of ink mist can be greatly reduced by this relatively simple method while maintaining high image quality.

Further features of the present invention will become apparent from the following description of exemplary embodiments (with reference to the attached drawings).

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "nozzle" generally means a set of a discharge orifice, a liquid channel connected to the orifice and an element to generate energy utilized for ink discharge.

Figure 7:
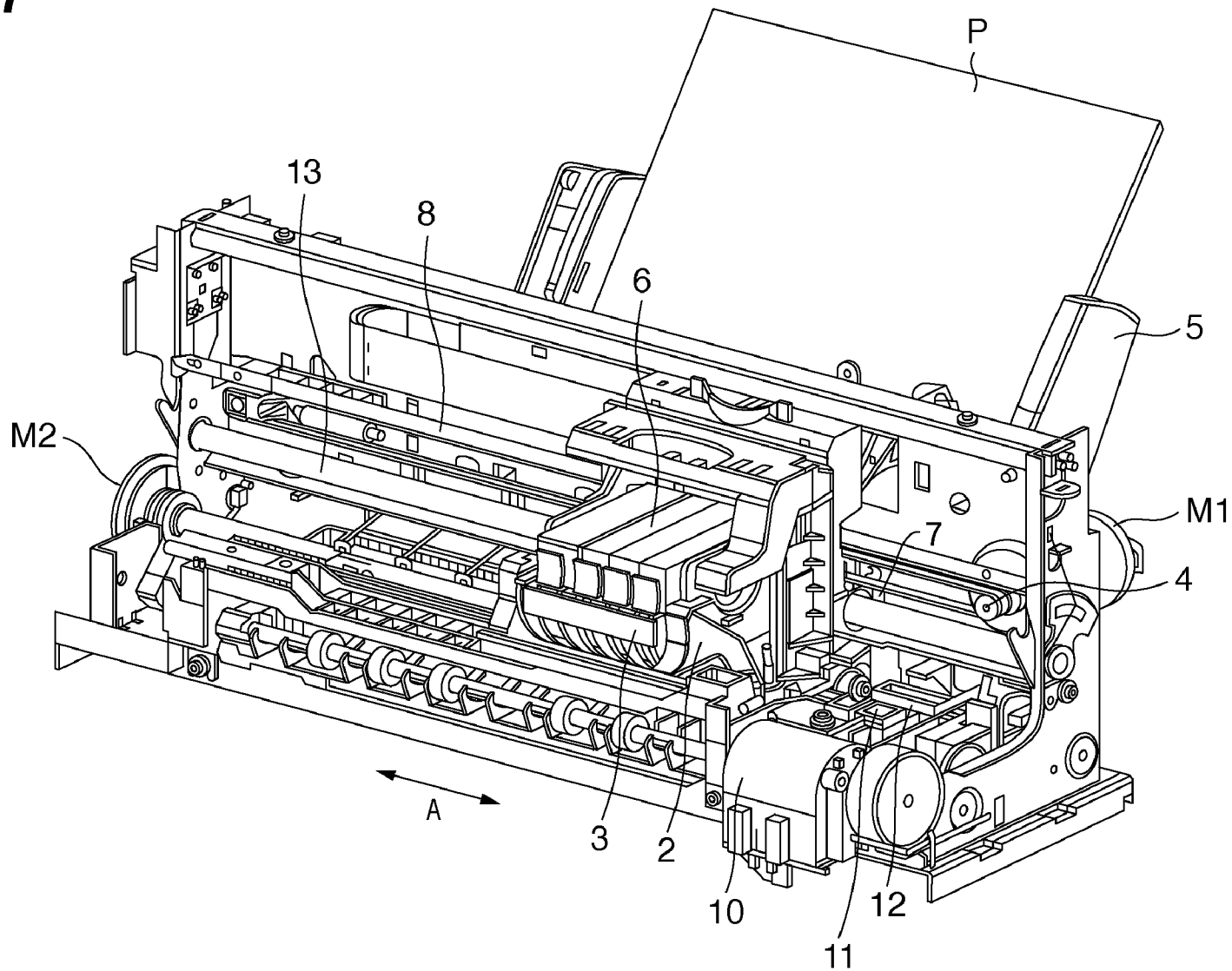
FIG. 7 is a schematic perspective view showing the outer appearance of the structure of an inkjet printing apparatus as a typical embodiment of the present invention.

FIG. 7 is a schematic perspective view showing the outer appearance of the structure of an inkjet printing apparatus as a typical embodiment of the present invention.

As shown in FIG. 7, the inkjet printing apparatus (to be referred to as a printing apparatus hereinafter) comprises a printhead 3 which prints by discharging ink according to the inkjet method. A transmission mechanism 4 transmits a driving force generated by a carriage motor M1 to a carriage 2 supporting the printhead 3 to reciprocate the carriage 2 in directions (main scanning direction) indicated by an arrow A (reciprocal scanning). Along with this reciprocal scanning, a print medium P such as print paper is fed via a paper feed mechanism 5 and conveyed to a print position. At the print position, the printhead 3 prints by discharging ink to the print medium P.

The carriage 2 of the printing apparatus supports not only the printhead 3, but also an ink tank 6 which contains ink to be supplied to the printhead 3. The ink tank 6 is detachable from the carriage 2.

The printing apparatus shown in FIG. 7 can print in color. For this purpose, the carriage 2 supports four ink tanks which respectively contain magenta (M), cyan (C), yellow (Y), and black (K) inks. The four ink tanks are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with a printing signal. In particular, the printhead 3 according to the embodiment adopts an inkjet method of discharging ink by using heat energy, and comprises an electrothermal transducer for generating heat energy. Electric energy applied to the electrothermal transducer is converted into heat energy. Ink is discharged from orifices by using a change in pressure upon growth and contraction of bubbles by film boiling generated by applying the heat energy to ink. The electrothermal transducer is arranged in correspondence with each orifice, and ink is discharged from a corresponding orifice by applying a pulse voltage to a corresponding electrothermal transducer in accordance with a printing signal.

As shown in FIG. 7, the carriage 2 is coupled to part of a driving belt 7 of the transmission mechanism 4 which transmits the driving force of the carriage motor M1. The carriage 2 is slidably guided and supported along a guide shaft 13 in the directions indicated by the arrow A. The carriage 2 reciprocates along the guide shaft 13 by normal rotation and reverse rotation of the carriage motor M1. A scale 8 representing the position of the carriage 2 is arranged along the main scanning direction (directions indicated by the arrow A) of the carriage 2.

The printing apparatus has a platen (not shown) facing the orifice surface of the printhead 3 having orifices (not shown). The carriage 2 supporting the printhead 3 reciprocates by the driving force of the carriage motor M1. At the same time, the printhead 3 receives a printing signal to discharge ink and print by the entire width of the print medium P conveyed onto the platen.

In the printing apparatus, a recovery unit 10 for recovering the printhead 3 from a discharge failure is arranged at a position outside the reciprocation range (outside the printing area) for the printing operation of the carriage 2 supporting the printhead 3.

The recovery unit 10 comprises a capping mechanism 11 which caps the orifice surface of the printhead 3, and a wiping mechanism 12 which cleans the orifice surface of the printhead 3. The recovery unit 10 performs a discharge recovery operation. For example, the recovery unit 10 forcibly discharges ink from orifices by a suction means (suction pump or the like) within the recovery unit in synchronism with capping of the orifice surface by the capping mechanism 11. Accordingly, the recovery unit 10 removes ink with high viscosity or bubbles from the ink channel of the printhead 3.

In a non-printing operation or the like, the capping mechanism 11 caps the orifice surface of the printhead 3 to protect the printhead 3 and prevent evaporation and drying of ink. The wiping mechanism 12 is arranged near the capping mechanism 11, and wipes ink droplets attached to the orifice surface of the printhead 3.

The printing apparatus can execute preliminary discharge by discharging ink to the capping mechanism 11 independently of printing.

The ink discharge state of the printhead 3 can be kept normal by the suction operation and preliminary discharge operation using the capping mechanism 11, and the wiping operation using the wiping mechanism 12.

Figure 8:
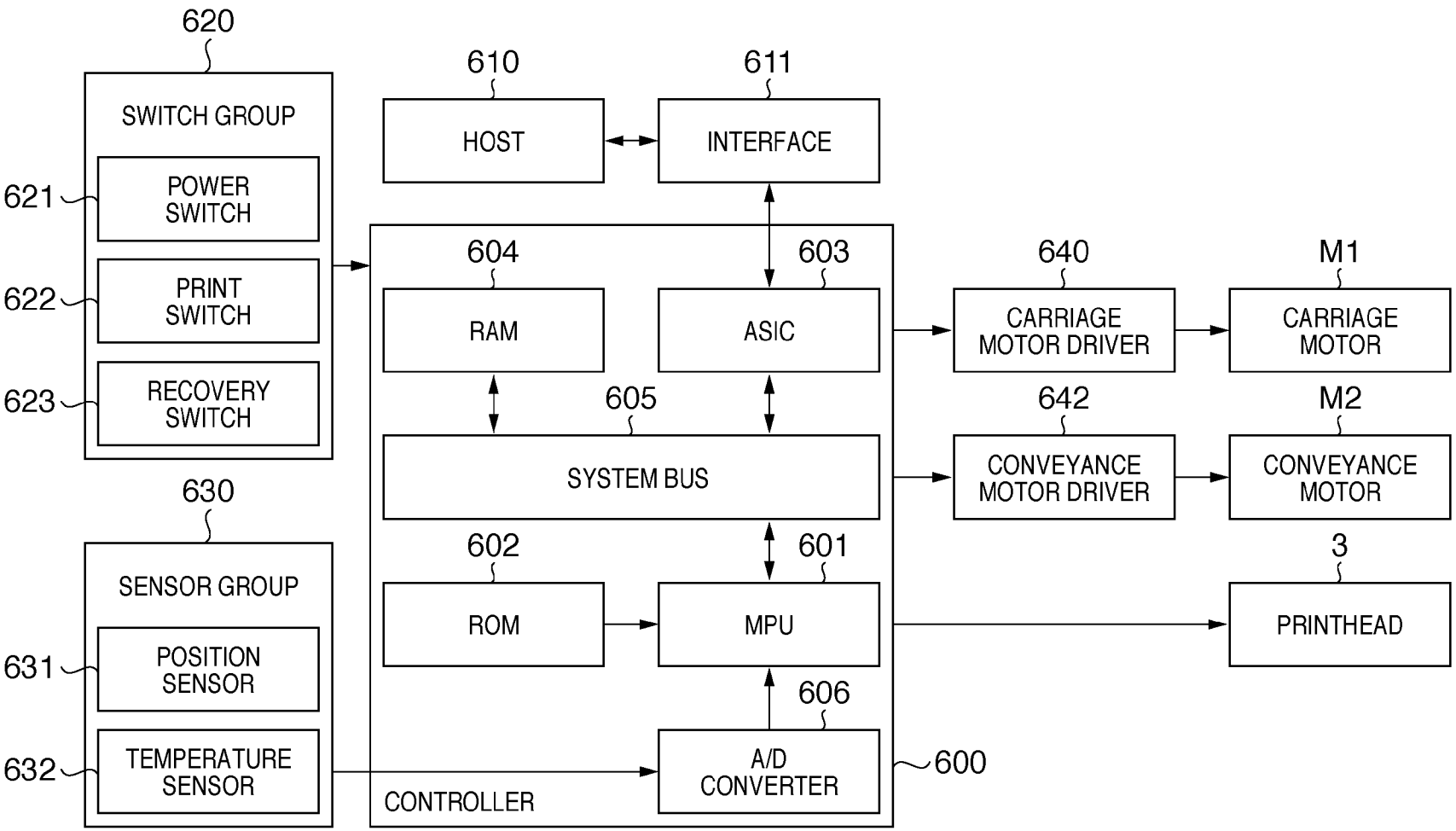
FIG. 8 is a block diagram showing the arrangement of the control circuit of the printing apparatus.

FIG. 8 is a block diagram showing the control arrangement of the printing apparatus shown in FIG. 7.

As shown in FIG. 8, a controller 600 includes a MPU 601, and a ROM 602 which stores a predetermined table and other permanent data. The controller 600 also includes an ASIC (Application Specific Integrated Circuit) 603 which generates control signals for controlling the carriage motor M1, a conveyance motor M2, and the printhead 3. The controller 600 further includes a RAM 604 having an image data rasterization area, a work area for executing a program, and the like, and a system bus 605 which connects the MPU 601, ASIC 603, and RAM 604 to each other and allows exchanging data. In addition, the controller 600 includes an A/D converter 606 which A/D-converts analog signals input from a sensor group (to be described below) into digital signals, and supplies the digital signals to the MPU 601. The controller 600 drives the nozzles such that they are driven at predetermined time intervals in preliminary discharge and printing.

Reference numeral 610 denotes a computer which serves as an image data supply source and is generically named a host. The host 610 and printing apparatus transmit/receive image data, commands, status signals, and the like via an interface (I/F) 611.

A switch group 620 includes switches for receiving instruction inputs from the user, such as a power switch 621, a print switch 622 for designating the start of printing, and a recovery switch 623 for designating start-up of the recovery operation. A sensor group 630 detects an apparatus state, and includes a position sensor 631 such as a photocoupler for detecting a home position, and a temperature sensor 632 arranged at a proper portion of the printing apparatus in order to detect the ambient temperature.

A carriage motor driver 640 drives the carriage motor M1, and a conveyance motor driver 642 drives the conveyance motor M2.

FIG. 7 shows a structure in which the ink tank 6 and printhead 3 are separated, but the embodiment may also adopt a head cartridge which integrates the ink tank and printhead.

Figure 9:
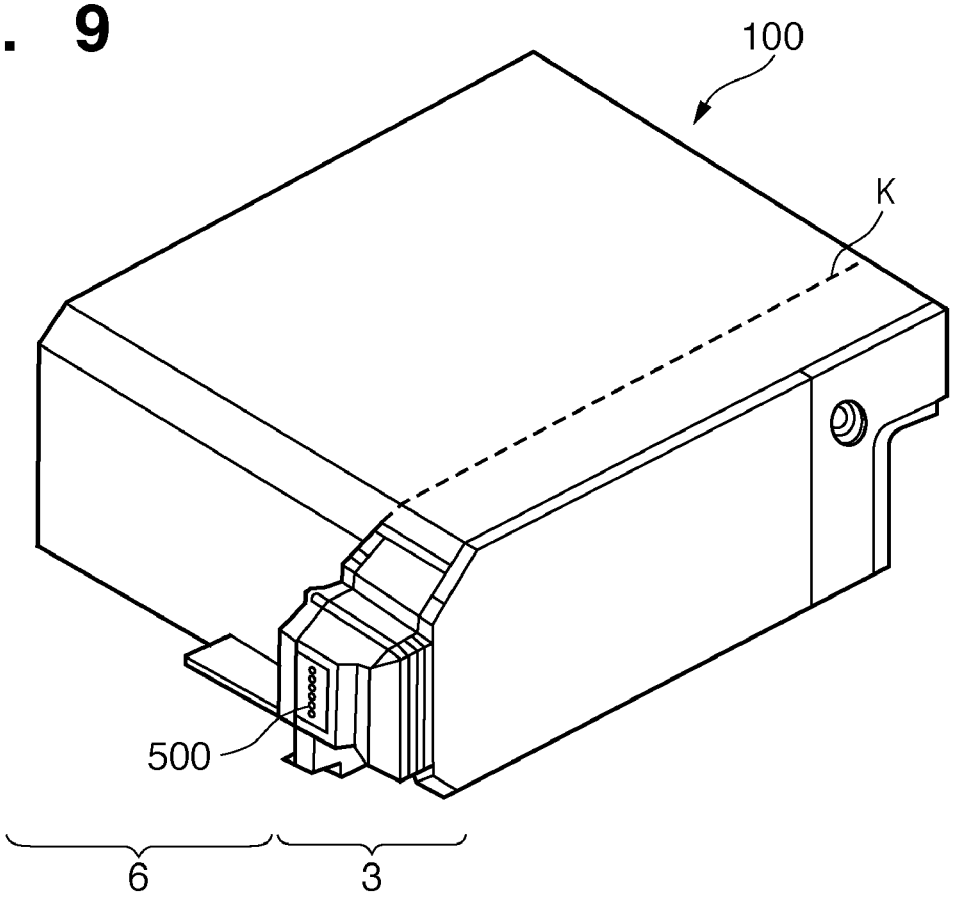
FIG. 9 is a perspective view showing the outer appearance of the structure of a head cartridge which integrates an ink tank and printhead.

FIG. 9 is a perspective view showing the outer appearance of the structure of a head cartridge 100 which integrates the ink tank 6 and printhead 3. In FIG. 9, a dotted line K indicates the boundary between the ink tank 6 and the printhead 3. An ink orifice array 500 is an array of orifices. Ink contained in the ink tank 6 is supplied to the printhead 3 via an ink supply channel (not shown). The head cartridge 100 has an electrode (not shown) to receive an electrical signal supplied from the carriage 2 when the head cartridge 100 is mounted on the carriage 2. The electrical signal drives the printhead 3 to selectively discharge ink from the orifices of the ink orifice array 500.

First Embodiment

As a method of driving a printhead 3 in the above-described inkjet printing apparatus, the apparatus employs a block division driving method of dividing a plurality of orifices into a plurality of blocks and simultaneously driving orifices of each block. The time intervals at which respective blocks are driven are equal, are called block intervals, and represented by $t_b$ in this specification.

The first embodiment uses a printhead in which nozzles arrayed in line are divided into 16 blocks and time-divisionally driven.

Figure 1:
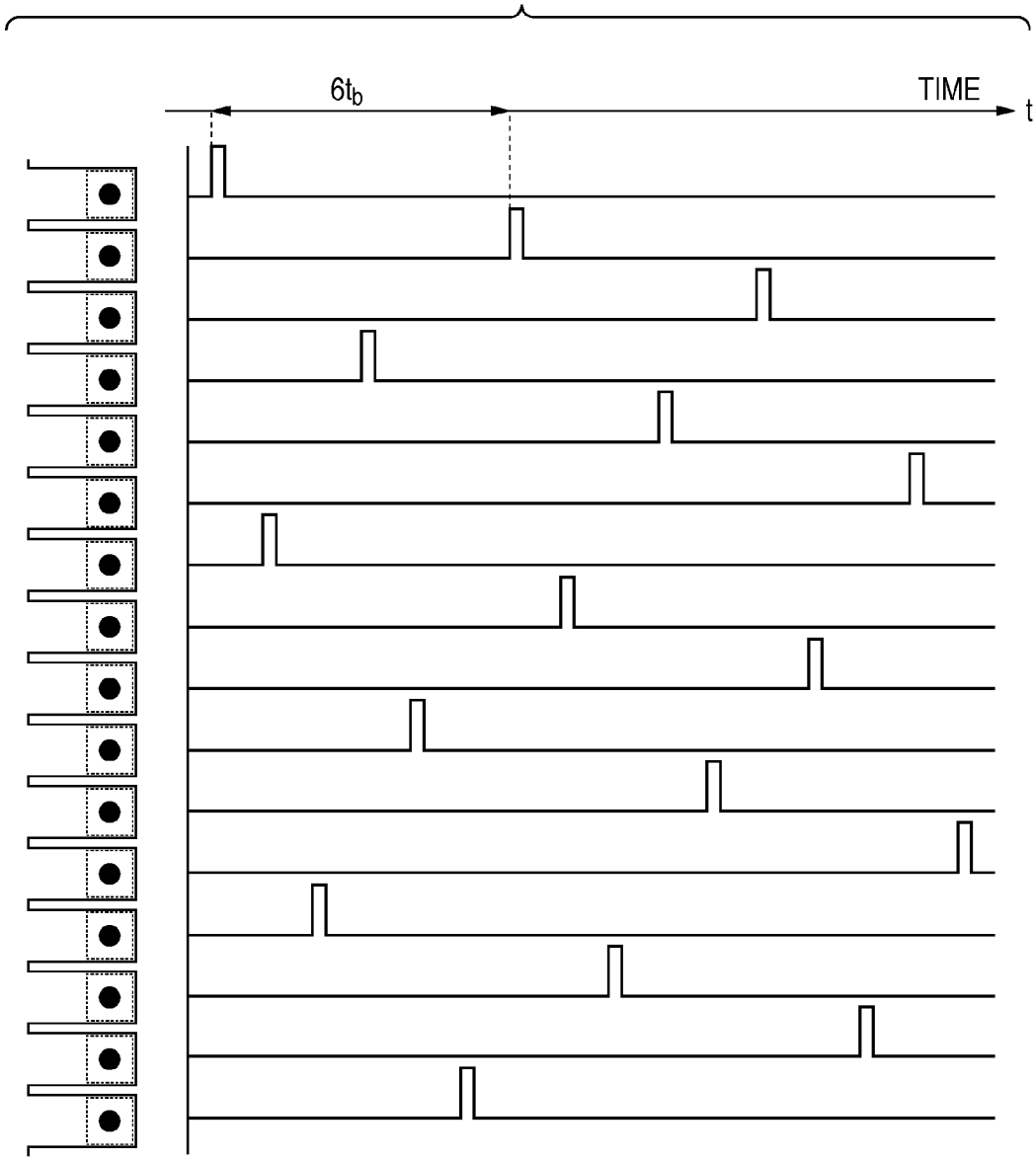
FIG. 1 is a timing chart showing a nozzle drive sequence in printing according to the first embodiment.

FIG. 1 is a driving timing chart for 16 adjacent nozzles of the printhead in printing. The left side of FIG. 1 shows the orifices of 16 adjacent nozzles, and driving signals corresponding to the respective orifices are shown in a predetermined sequence from the left to right in FIG. 1. The respective orifices start the discharge operation in accordance with the driving signals.

In printing, it is desirably designed to perform the discharge operation by minimizing the influence of crosstalk in order to prevent degradation of the image quality. For this purpose, adjacent nozzles need to be driven at a time interval as large as possible. In the first embodiment, nozzles at discrete positions are sequentially driven as shown in the driving timing chart of FIG. 1. At each nozzle, the time interval at which adjacent nozzles are driven is 5 to 6 $t_b$ at minimum. In this way, the time interval at which adjacent nozzles are drive can be maximized.

Figure 2:
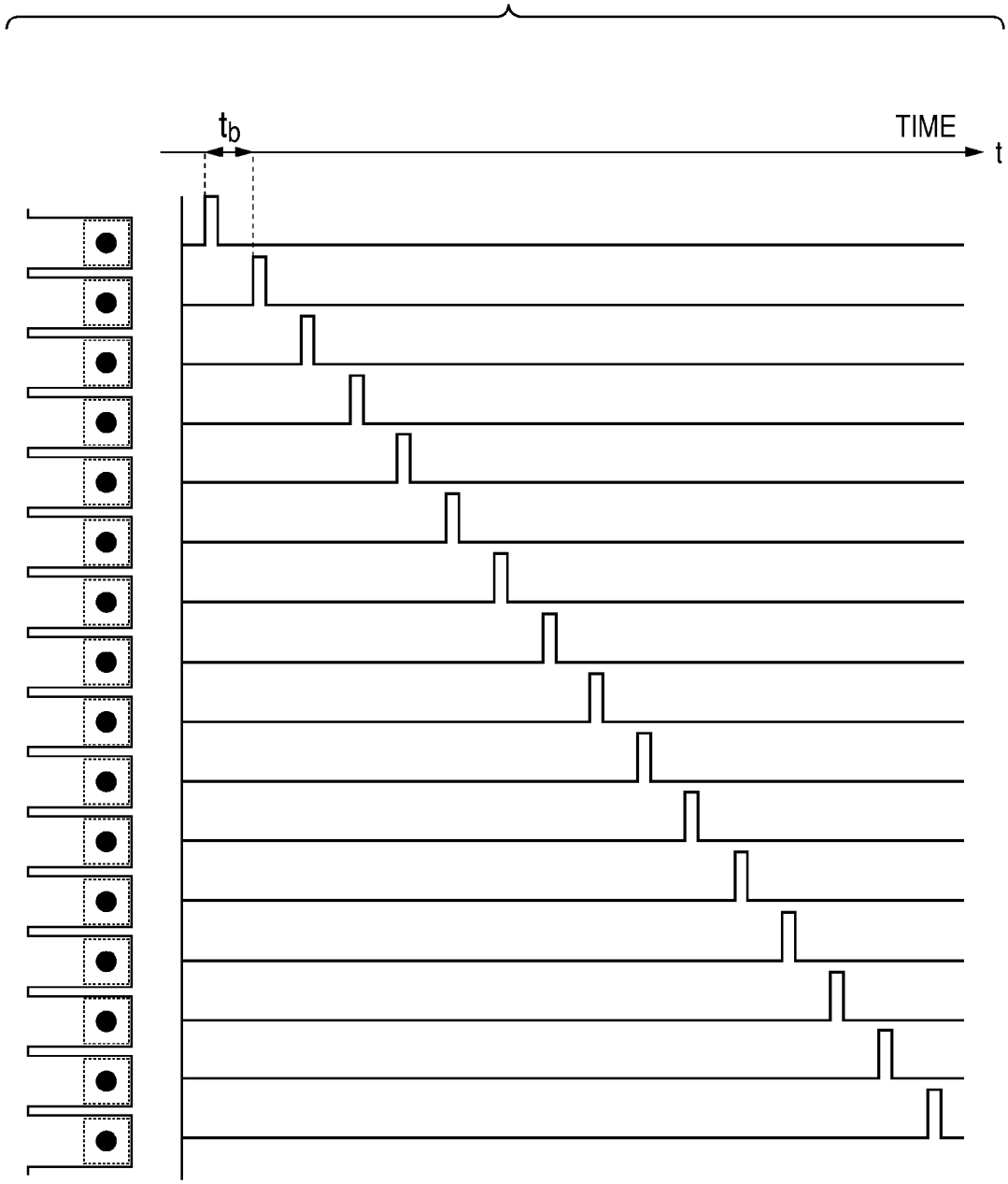
FIG. 2 is a timing chart showing a nozzle drive sequence in preliminary discharge according to the first embodiment.

FIG. 2 is a driving timing chart for the same 16 nozzles as those shown in FIG. 1 in discharge (preliminary discharge) irrelevant to ink discharge for printing an image. Since preliminary discharge is not ink discharge for forming an image, the drive sequence of nozzles can be designed regardless of the influence of crosstalk. Thus, in this case a driving method considering only suppression of satellite droplets can be employed. In the first embodiment, as shown in the driving timing chart of FIG. 2, the time interval at which adjacent nozzles are driven is equal to the block interval $t_b$ at each nozzle. At this driving time interval, adjacent nozzles are sequentially driven.

Figure 3:
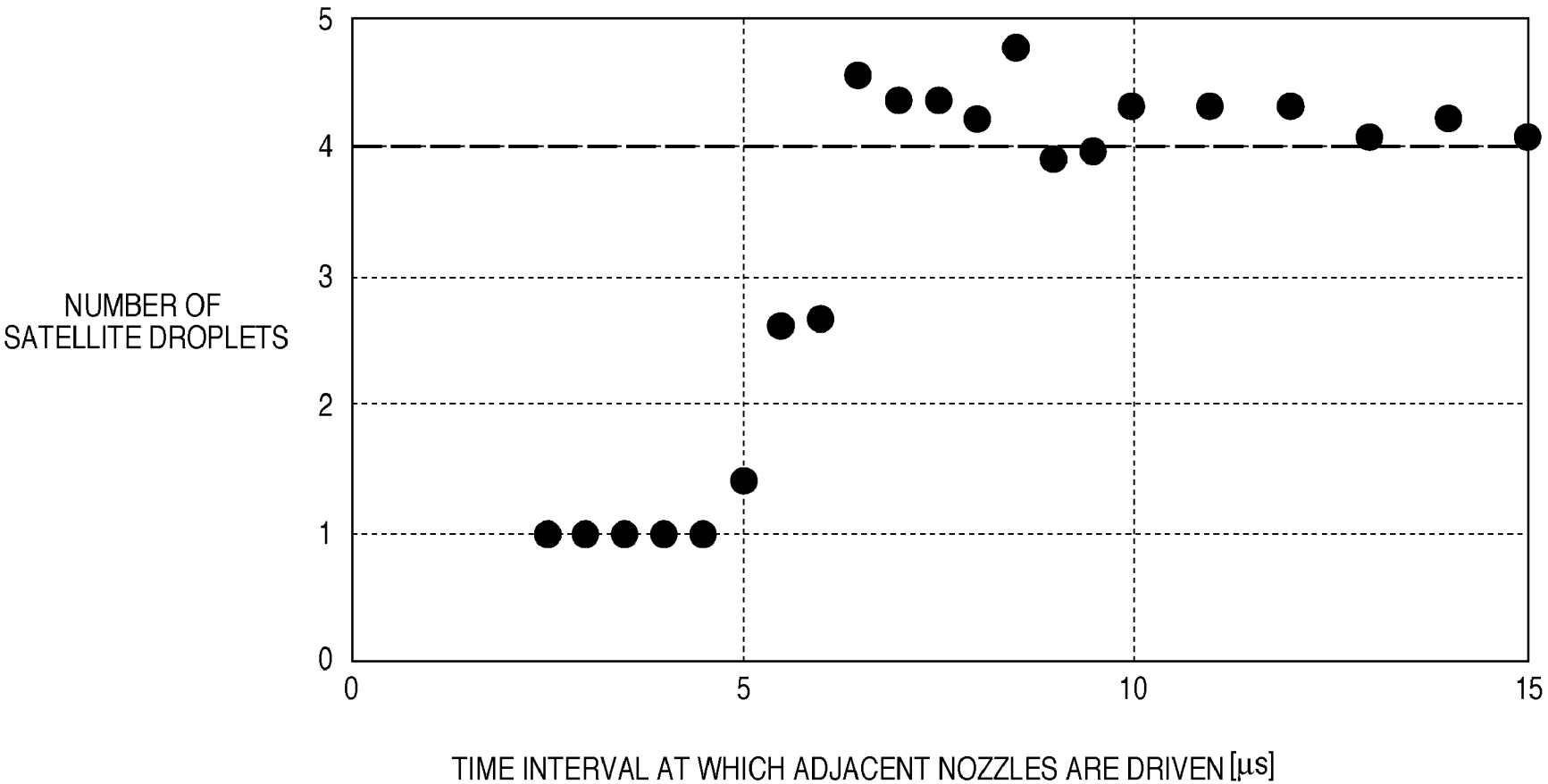
FIG. 3 is a graph showing the relationship between the number of satellite droplets and the time interval at which adjacent nozzles are driven.

The study made by the present inventor reveals that the satellite droplet formation condition of an ink droplet discharged from an orifice changes by changing the time interval at which adjacent nozzles are driven. FIG. 3 shows the relationship between the number of satellite droplets 50 μs after the start of discharge and the time interval at which adjacent nozzles are driven in a printhead having a discharge amount of 5 pl as the printhead of the first embodiment. In FIG. 3, the abscissa axis represents the time interval at which adjacent nozzles are driven, and the ordinate axis represents the number of satellite droplets.

FIG. 3 shows that the number of satellite droplets changes by changing the time interval at which adjacent nozzles are driven. A bold broken line in FIG. 3 represents the number of satellite droplets by a conventional driving method. When the time interval at which adjacent nozzles are driven is equal to or shorter than 5.0 μs, the number of satellite droplets is much smaller than the conventional one. It is found that the number of satellite droplets increases when the time interval at which adjacent nozzles are driven exceeds 5.0 μs. While the time interval at which adjacent nozzles are driven is short, the number of satellite droplets is small. Here, $t_d$ is defined as the time when the number of satellite droplets abruptly increases.

Figure 4:
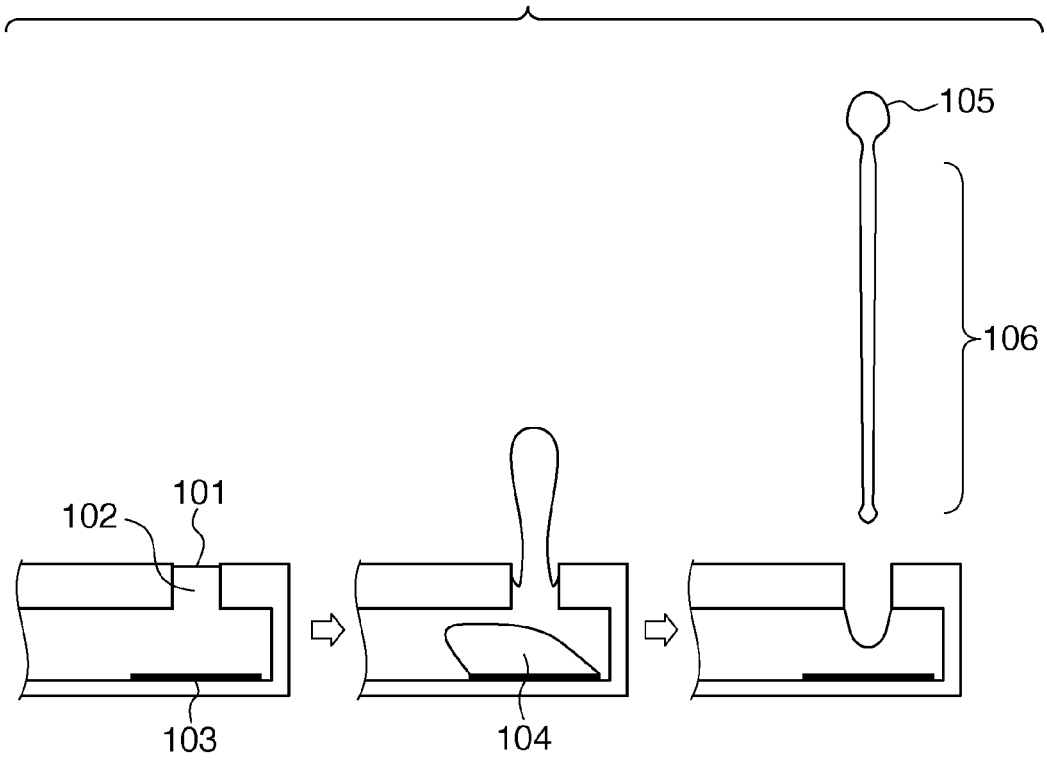
FIG. 4 is a view showing a discharge state according to a conventional driving method.

FIG. 4 is a view showing a discharge state according to a conventional driving method. FIG. 4 shows that ink discharged from an orifice 102 by driving a heater (electrothermal transducer) 103 and generating a bubble 104 is broken into a part called a main droplet 105 and a part called a tail 106. The tail 106 is broken up and coalesces into a small droplet called a satellite droplet. Some of satellite droplets that cannot reach a print medium float as ink mist. Thus, it is considered that as the tail 106 is shorter, the floating ink mist amount is smaller.

Figure 5A:
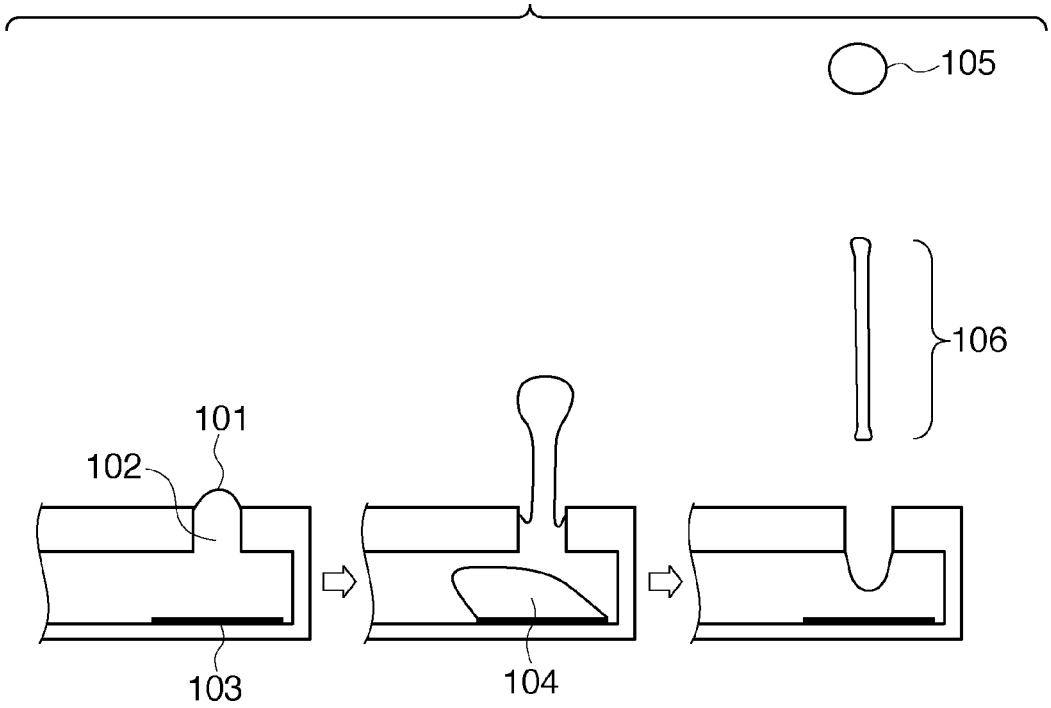
FIGS. 5A and 5B are views showing discharge states when the ink meniscus is convex and concave.

FIG. 5A is a schematic view showing a discharge state when the time interval at which adjacent nozzles are driven is equal to or shorter than 5.0 μs ($t_d$). When the time interval at which adjacent nozzles are driven is equal to or shorter than 5.0 μs, an ink meniscus 101 is convex upon driving the heater 103, and the amount of ink in the ink discharge direction is large. In this case, discharge starts while the ink leading end projects, so the discharged ink leading end tends to become spherical. As a result, the discharged ink leading end tends to be broken quickly as the main droplet 105, the tail 106 of the discharged ink trailing end becomes short, and the number of satellite droplets decreases.

Figure 5B:
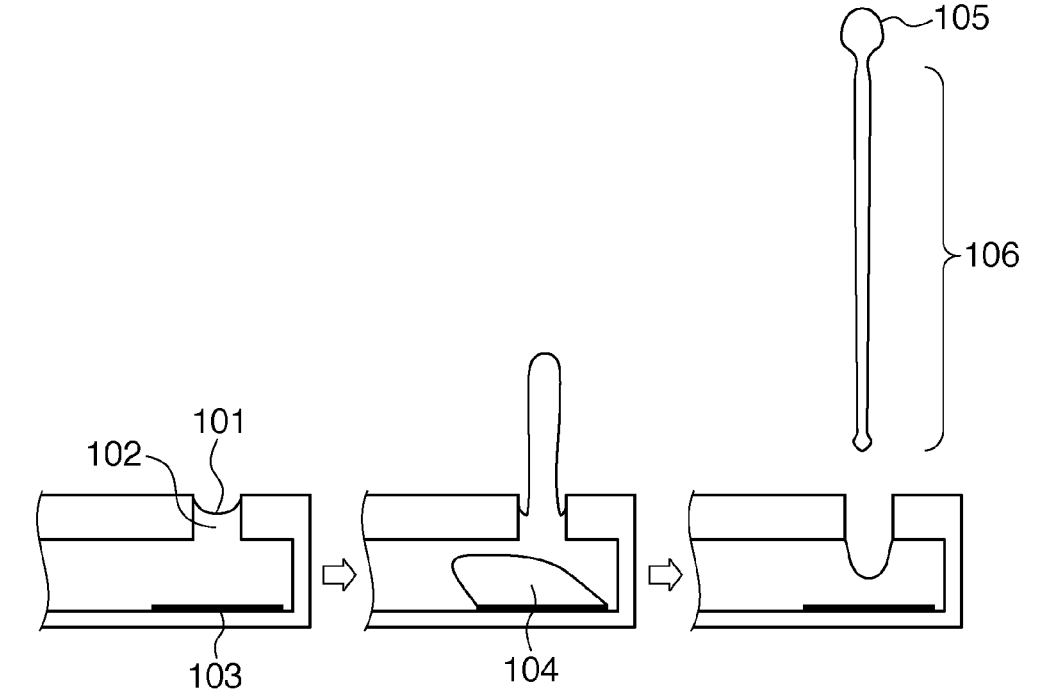

FIG. 5B is a schematic view showing a discharge state when the time interval at which adjacent nozzles are driven ranges from 7.0 μs (inclusive) to 10.0 μs (inclusive). When the time interval at which adjacent nozzles are driven is equal to or longer than 7.0 μs, the ink meniscus 101 is concave upon driving the heater 103, and the amount of ink in the ink discharge direction is small. In this case, discharge starts while the ink leading end has a columnar shape, so the discharged ink leading end hardly becomes spherical. Thus, the time until the discharged ink leading end is broken as the main droplet 105 tends to be long, the tail 106 of the discharged ink trailing end becomes long, and the number of satellite droplets increases.

In short, to discharge ink droplets while decreasing the number of satellite droplets in order to reduce the amount of floating ink mist, the time interval at which adjacent nozzles are driven suffices to be shorter than $t_d$.

As the first predetermined time interval, the block interval $t_b$ is set to 2.0 μs (inclusive) to 5.0 μs (inclusive) in preliminary discharge according to the first embodiment. Thus, the time interval at which adjacent nozzles are driven is set to 2.0 μs (inclusive) to 5.0 μs (inclusive) to decrease satellite droplets.

As the second predetermined time interval, the time interval at which adjacent nozzles are driven is set to as long as 10.0 μs (inclusive) to 25.0 μs (inclusive) in printing according to the first embodiment. This time interval contributes to reducing the influence of crosstalk.

The above-described embodiment can reduce the influence of crosstalk and decrease mist floating in preliminary discharge while keeping the quality of a printed image high.

Second Embodiment

Similar to the first embodiment, the second embodiment uses a printhead in which nozzles arrayed in line are divided into 16 blocks and time-divisionally driven.

In the second embodiment, the drive sequence of nozzles in printing is the same as that described with reference to FIG. 1. This drive sequence maximizes the time interval at which adjacent nozzles are driven, and reduces the influence of crosstalk.

Figure 6:
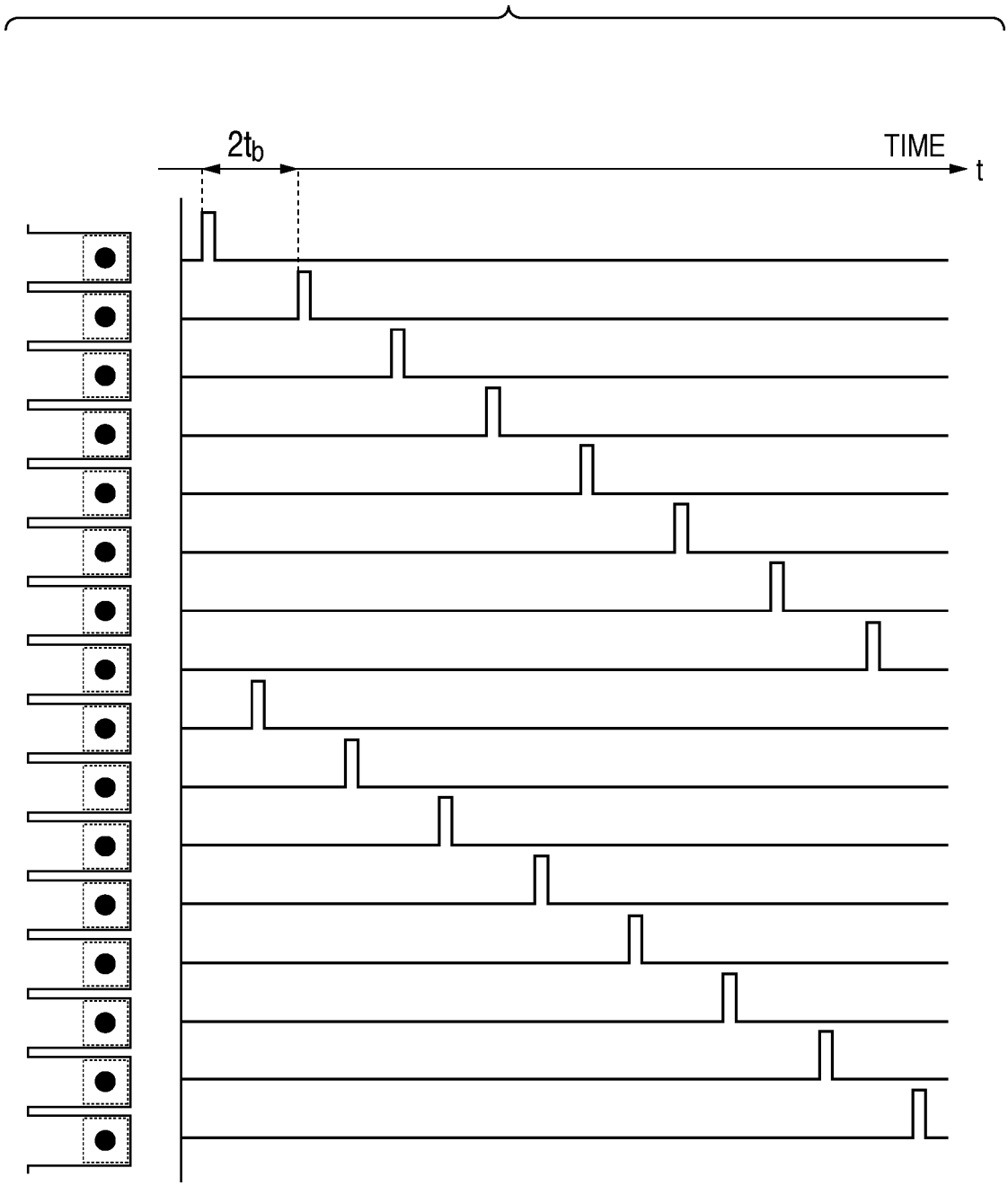
FIG. 6 is a timing chart showing a nozzle drive sequence in preliminary discharge according to the second embodiment.

FIG. 6 shows the drive sequence of nozzles in preliminary discharge according to the second embodiment. As shown in the timing chart of FIG. 6, the time interval at which adjacent nozzles are driven is double the block interval, that is, 2 $t_b$ at each orifice. At this time, by setting the block interval to 1.0 μs (inclusive) to 2.5 μs (inclusive), the time interval at which adjacent nozzles are driven becomes 2.0 μs (inclusive) to 5.0 μs (inclusive). With these settings, discharge starts when the meniscus of an orifice is convex, and thus discharge almost free from satellite droplets can be achieved. As a result, mist floating in preliminary discharge can be reduced.

Accordingly, the above-described embodiment can also reduce the influence of crosstalk and decrease mist floating in preliminary discharge while keeping the quality of a printed image high.

Although the driving time interval between adjacent nozzles is controlled in the above-described embodiments, crosstalk may influence not only adjacent nozzles (which are situated next to each other) but also neighboring nozzles. The present invention includes even a case where the driving time interval between nozzles at discrete positions where crosstalk may influence them, that is, neighboring nozzles is controlled in addition to the driving time interval between adjacent nozzles.

Figure 10:
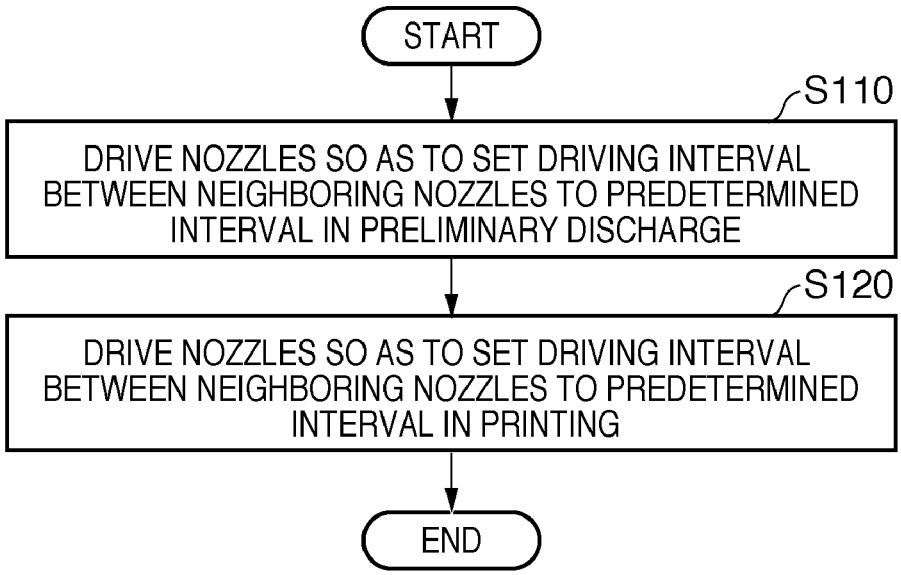
FIG. 10 is a flowchart showing an example of a printhead driving method according to the present invention.

An example of a printhead driving method according to the present invention will be explained with reference to the flowchart of FIG. 10.

In step S110, a plurality of nozzles are driven for each block so as to set the driving time interval between neighboring nozzles in preliminary discharge to the first time interval (first driving). For example, the nozzles are driven in a drive sequence which sets the driving time interval between neighboring nozzles to a predetermined time interval so as to drive nozzles when the ink meniscus becomes convex. In step S120, a plurality of nozzles are driven for each block so as to set the driving time interval between neighboring nozzles in printing to the second time interval longer than the first time interval (second driving). For example, the nozzles are driven in a drive sequence which sets the driving time interval between neighboring nozzles in printing to be longer than that in preliminary discharge in order to prevent the influence of crosstalk.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-189994, filed Jul. 20, 2007, which is hereby incorporated by reference herein in its entirety.

What is claimed is:

1. An inkjet printing apparatus which prints by time-divisionally driving, for each block, a plurality of nozzles for discharging ink, the apparatus comprising:

first driving means for driving the plurality of nozzles so as to set a driving time interval between neighboring nozzles in preliminary discharge to a first time interval; and second driving means for driving the plurality of nozzles so as to set the driving time interval between neighboring nozzles in printing to a second time interval longer than the first time interval.

2. The apparatus according to claim 1, wherein said first driving means drives the plurality of nozzles so as to sequentially drive adjacent nozzles, and said second driving means drives the plurality of nozzles so as to sequentially drive discrete nozzles.

3. The apparatus according to claim 1, wherein the first time interval ranges from 2.0 μs, inclusive, to 5.0 μs, inclusive.

4. The apparatus according to claim 1, wherein the second time interval ranges from 10.0 μs, inclusive, to 25.0 μs, inclusive.

5. An inkjet printing apparatus which prints an image by time-divisionally driving a plurality of nozzles for discharging ink, the apparatus comprising:

first driving means for driving the plurality of nozzles so as to set a driving interval between adjacent nozzles in preliminary discharge to a first interval; and second driving means for driving the plurality of nozzles so as to set the driving interval between adjacent nozzles in image printing to a second interval longer than the first interval, wherein the number of satellite droplets discharged when said first driving means drives the plurality of nozzles is smaller than the number of satellite droplets discharged when said second driving means drives the plurality of nozzles.

6. A method of driving a printhead which prints by time-divisionally driving, for each block, a plurality of nozzles for discharging ink, the method comprising steps of:

driving the plurality of nozzles so as to set a driving time interval between neighboring nozzles in preliminary discharge to a first time interval; and driving the plurality of nozzles so as to set the driving time interval between neighboring nozzles in printing to a second time interval longer than the first time interval.

* * * * *